US009669908B2

(12) United States Patent
Darcy

(10) Patent No.: US 9,669,908 B2
(45) Date of Patent: Jun. 6, 2017

(54) SKIING ACCESSORY

(71) Applicant: Genias Ventures Pty Ltd, Ashmore (AU)

(72) Inventor: Steve Darcy, Ashmore (AU)

(73) Assignee: Genias Ventures Pty Ltd, Ashmore (AU)

( * ) Notice: Subject to any disclaimer, the term of this patent is extended or adjusted under 35 U.S.C. 154(b) by 29 days.

(21) Appl. No.: 14/762,467

(22) PCT Filed: Jan. 22, 2014

(86) PCT No.: PCT/AU2014/000038
§ 371 (c)(1),
(2) Date: Jul. 22, 2015

(87) PCT Pub. No.: WO2014/113841
PCT Pub. Date: Jul. 31, 2014

(65) Prior Publication Data

US 2015/0360757 A1 Dec. 17, 2015

(30) Foreign Application Priority Data

Jan. 23, 2013 (AU) ..... 2013900207
Jun. 20, 2013 (AU) ..... 2013902253

(51) Int. Cl.

| | |
|---|---|
| ***B63B 35/81*** | (2006.01) |
| ***B63B 35/85*** | (2006.01) |
| ***B63B 17/00*** | (2006.01) |
| ***B61B 11/00*** | (2006.01) |

(52) U.S. Cl.
CPC ..... *B63B 35/85* (2013.01); *B61B 11/004* (2013.01); *B63B 35/815* (2013.01)

(58) Field of Classification Search
CPC ..... B63B 35/85; B63B 35/815; B61B 11/004
USPC ..... 441/67, 68, 72, 73, 79
See application file for complete search history.

(56) References Cited

U.S. PATENT DOCUMENTS

| | | | | |
|---|---|---|---|---|
| 2,814,811 | A * | 12/1957 | Ritter, Jr. | B63B 1/22 280/16 |
| 2,958,875 | A | 11/1960 | McClain | |
| 3,326,175 | A | 6/1967 | Baker | |
| 3,390,658 | A * | 7/1968 | Jelks | B63B 35/817 114/242 |
| 4,480,577 | A | 11/1984 | Naypaver | |
| 5,000,109 | A | 3/1991 | Anderson | |
| 5,100,354 | A | 3/1992 | Woolley et al. | |
| 5,241,921 | A | 9/1993 | Sadlak | |
| 5,730,078 | A | 3/1998 | Rummell et al. | |
| 5,943,977 | A | 8/1999 | Womack et al. | |
| 7,604,522 | B1 | 10/2009 | Burnham | |

(Continued)

*Primary Examiner* — Anthony Wiest
(74) *Attorney, Agent, or Firm* — Eagar & Martin Pty Ltd.

(57) ABSTRACT

A skiing accessory comprises a support structure, a mounting arrangement and a lift member. The support structure is configured to support a user relative to a body of water. The mounting arrangement is configured to connect the support structure to a ski boom. The lift member is arranged on the support structure and configured to engage the body of water such that the support structure is raised or lifted, relative to the body of water, by the lift member as the accessory is towed. The mounting arrangement permits the support structure to be pivotally connected to the ski boom about an axis that is generally parallel to the ski boom.

16 Claims, 22 Drawing Sheets

(56) References Cited

U.S. PATENT DOCUMENTS

| | | | |
|---|---|---|---|
| 7,762,206 | B2 | 7/2010 | Seipel et al. |
| 2008/0289557 | A1 | 11/2008 | Seipel et al. |

* cited by examiner

SKIING ACCESSORY

FIELD

This invention relates to a skiing accessory. The skiing accessory is suitable for towing a skier.

SUMMARY

According to one aspect of the invention, there is provided a skiing accessory comprising a support structure which is configured to support a user relative to a skiing substrate;

a mounting arrangement configured to connect the support structure to a towing device; and at least one substrate-engaging member arranged on the support structure and configured to engage the substrate as the accessory is towed such that the support structure is raised or lifted, relative to the substrate, by the substrate-engaging member as the accessory is towed.

The skiing accessory may be suitable for use with a ski boom. The mounting arrangement may thus be configured to permit the support structure to be pivotally connected to the ski boom about an axis that is generally parallel to the ski boom.

The support structure may extend from the mounting arrangement to the substrate-engaging member.

The support structure may include a seat arrangement to permit a user to sit on the support structure if required.

The, or each, substrate-engaging member may be a lift member. The lift member may be configured so that when dragged through the water at a speed suitable for water-skiing, an upward force is exerted on the accessory sufficient to support a skier, for example an adult skier, in a seated position on the support structure.

Instead, the accessory may be suitable for use with a towing device used for snow skiing. Such a device could, for example, include a boom. In this example, the, or each lift member may include a snow-ski.

The inventor(s) envisages that the accessory may be suitable for other activities, such as ice skating. Broadly, the accessory may be suitable for any activities that require a user to practice balancing while being towed. For example, the accessory may also be suitable for roller-blading, skate-boarding and the like.

When used for water skiing, the lift member may be in the form of at least one elongate member that is of a selected length and profile to result in said upward force. The elongate member may be a post. The post may be generally cylindrical.

The lift member may be configured to be of variable length. For example, the lift member may comprises a post which is slideably receivable in a stem of the substrate-engaging member. The stem may include a series of longitudinally spaced openings and the post may include a pin receivable in one of the openings to set the length of the lift member.

The substrate-engaging member may include a blade oriented relative to the lift member to assist in providing the upward force.

The pivotal mounting arrangement may include at least one swivel connector fastenable to the ski boom.

The support structure may include at least one arm that is attached to a respective swivel connector so that when the connector is fastened to the ski boom, the, or each, arm can pivot about an axis parallel to the ski boom.

The support structure may include two arms attached to respective swivel connectors and a cross bar that interconnects the arms, the lift member extending from the cross bar.

The swivel connector may include a releasable clamp assembly for clamping to the ski boom and a pivot mount that is pivotally connected to the clamp assembly, the arm being connected to the pivot mount.

The accessory may include two or more lift members connected to the support structure.

According to another aspect of the invention, there is provided a method of assisting a skier, the method comprising pivotally connecting a support structure of a skiing accessory to a towing device with at least a substrate-engaging member of the skiing accessory extending into the substrate;

supporting the skier relative to the substrate on the support structure; and towing the skiing accessory at sufficient speed so that a force is exerted by the substrate on the substrate-engaging member, thereby pivoting the support structure upwardly to raise or lift the skier relative to the substrate.

According to another aspect of the invention, there is provided a water ski boom that incorporates the accessory described above.

DEFINITIONS

"Front", "Rear" and any other terms indicating or representing direction or orientation in use are to be understood to be used for convenience only. The inventor(s) envisages that the ski accessory will be sold in a non-use configuration and, as such, any part of the summary, description or claims in which such words are used is not intended to be limiting.

"Ski" is to be understood as encompassing "skating", both on ice and with the use of a wheeled device, such as a skateboard or a pair of roller blades.

"Tow" is to be understood as encompassing both pulling and pushing a user.

DETAILED DESCRIPTION

Figure 1:
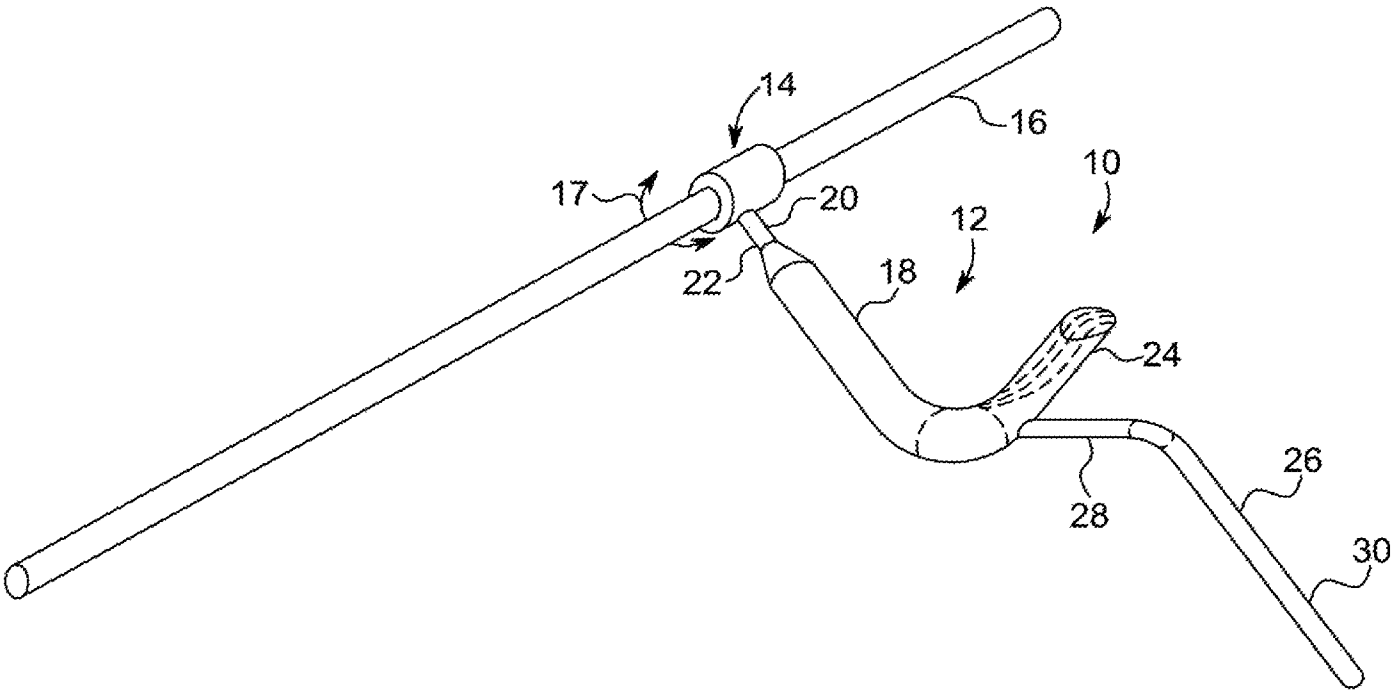
FIG. 1 shows a three-dimensional view of an exemplary embodiment of a water ski accessory.
Figure 2:
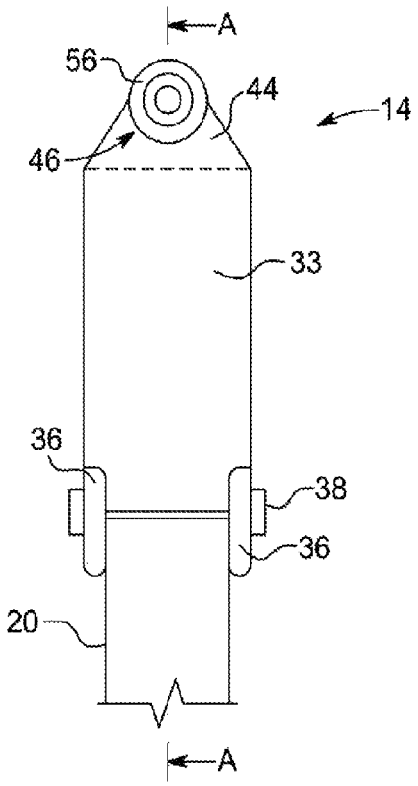
FIG. 2 shows a schematic front view of an exemplary embodiment of a swivel connector of the accessory.
Figure 3:
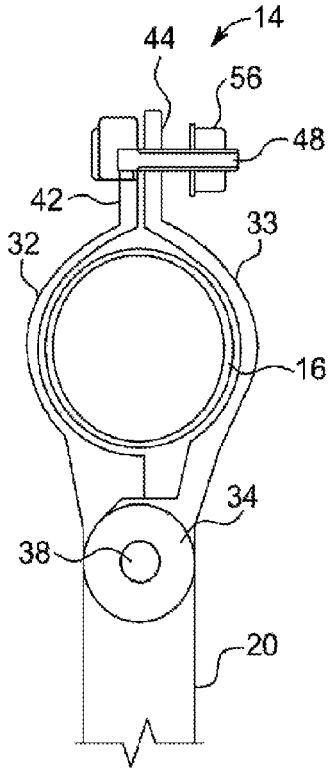
FIG. 3 shows a schematic sectioned side view of an exemplary embodiment of a swivel connector of the accessory taken through A-A in FIG. 2 in a closed condition.
Figure 4:
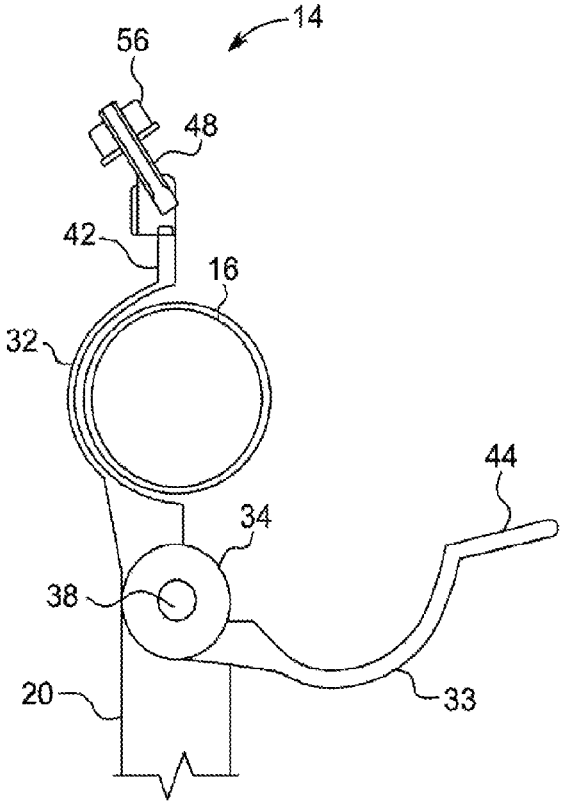
FIG. 4 shows a schematic sectioned side view of an exemplary embodiment of a swivel connector in an open condition.
Figure 5:
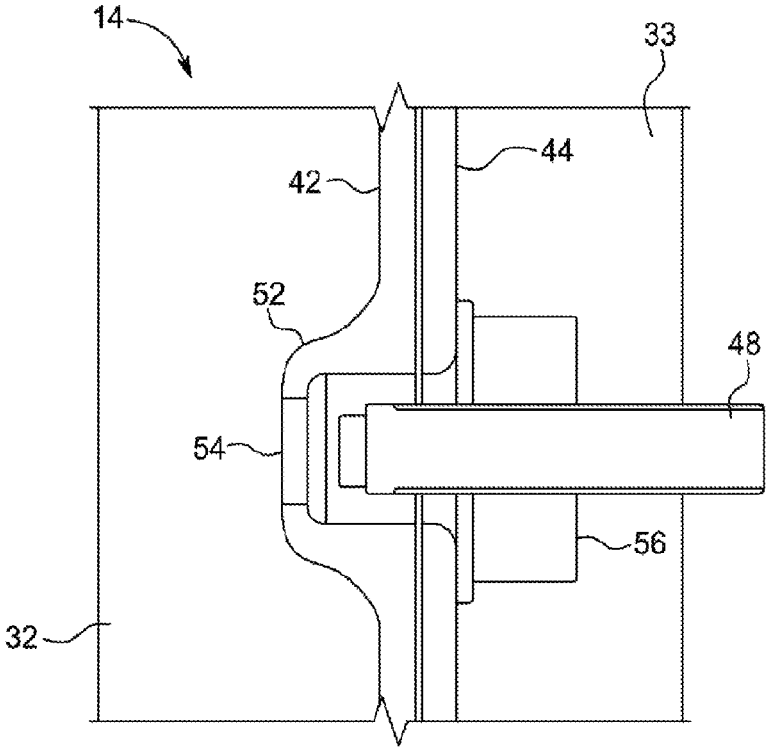
FIG. 5 shows a schematic plan view of an exemplary embodiment of a swivel connector of the accessory.

In FIG. 1, reference numeral 10 generally indicates an exemplary embodiment of a skiing accessory.

The skiing accessory 10 is particularly suited for water skiing. However, the inventor(s) envisages that the accessory 10 or embodiments of the skiing accessory can be used for other skiing activities, such as, but not exclusively, wake boarding, snow skiing, snowboarding, ice skating, skateboarding and rollerblading.

The accessory 10 includes a support structure 12. A pivotal mounting arrangement in the form of a swivel connector 14 connects the support structure 12 to a ski boom 16 of a tow craft such as a boat (not shown). The ski boom 16 extends generally perpendicular to the direction of travel of the boat and is generally parallel with the water surface. In this example, the ski boom 16 is conventional. However, the inventor(s) envisages that the ski boom 16 can be configured to incorporate the swivel connector 14. In other words, the swivel connector 14 can form part of the ski boom 16.

The swivel connector 14 is configured so that the support structure 12 can pivot about an axis that is parallel to the ski boom 16 as indicated by arrow 17.

The support structure 12 includes a seat arrangement 18. The seat arrangement 18 includes a support bar or arm 20 that is pivotally mounted to the ski boom 16 with the swivel connector 14.

In this embodiment, the arm 20 includes a front portion 22 that is generally straight and a rear portion 24 that is angled with respect to the front portion 22. Padding or cushioning is arranged on the arm 20 to provide a level of comfort to a user. The rear portion 24 is oriented with respect to the front portion 22 so that the rear portion 24 defines at least a lower backrest.

The skiing accessory 10 includes a substrate-engaging member in the form of a lift member 26. The lift member 26 is connected to the arm 20 of the support structure 12 and extends therefrom. The lift member 26 can also be in the form of a post or of bent tubing. In this example, the lift member 26 includes a front portion 28 that is connected to the arm 20 and a rear portion 30 that extends from the front portion 28, generally parallel to the front portion 22 of the arm 20.

The support structure 12 extends from the swivel connector 14 to the lift member 26.

The support structure 12 is dimensioned so that, when mounted on the boom 16, the support structure 12 is partially submerged while the tow craft is stationary. The lift member 26 is configured and dimensioned so that as the tow craft builds speed, the lift member 26 is driven upwardly as a result of drag, resulting in the support structure 12 and the lift member 26 pivoting upwardly.

The lift member 26 is configured and dimensioned so that when the tow craft is at a speed suitable, at least for conventional water skiing, an upward force generated as a result of the drag on the lift member 26 is sufficient to support a user seated on the seat arrangement 18. Thus, a user can elect to place his or her feet or skis on the water while he or she learns to ski.

For example, the lift member 26 is configured and dimensioned so that as the user begins to stand, the seat arrangement lifts together with the user to remain in close proximity, allowing the user to drop back into the seat arrangement 18 if required.

The support structure 12 and lift member 26 can together have an overall length of between about 1200 mm to 1800 mm, for example 1700 mm. A length of the front portion 22 of the arm 20 can be between about 600 mm to 800 mm, for example about 700 mm. A length of the rear portion 24 of the arm 20 can be between about 180 mm to 230 mm, for example about 200 mm. An overall length of the lift member 26 can be between about 800 mm and 1200 mm, for example about 1000 mm.

The arm 20 and the lift member 26 can be of tubing, for example metal tubing. The metal tubing may be aluminium tubing with an overall diameter of between about 30 mm and 50 mm, for example, about 40 mm. The tubing may be coated with a suitable protective material. An example is a coating of a plastics material, such as polyurethane or similar. The tubing may be powder coated with a powder such as thermoplastic or a thermoset polymer. It will be appreciated that other materials can also be used for the arm 20 and the lift member 26. These might include steel, carbon fibre, fibreglass or a plastics material.

The accessory 10 has been found to generate sufficient lift to support an average child at between about 30 km/h and 40 km/h, for barefoot water skiing.

For adults, a required speed for barefoot water skiing is between about 58 km/h and 72 km/h. The inventor(s) has found that, at this speed, the accessory 10 can generate sufficient lift to support an average adult. In fact, the accessory 10 can generate sufficient lift to support an average adult at speeds of as low as 40 km/h. It will be appreciated that the inventor(s) does not necessarily advocate speeds that would be unsafe for users.

When skis are used, a speed of between about 10 km/h and 20 km/h has been found to be sufficient for adults and children.

Without the accessory 10, a common danger with learning to ski in this fashion results from the need for the user to move directly from being submerged to supporting his or her weight without assistance. As a result, the user's feet or skis can dig into the water with the result that a user is driven head over heels into the water. The accessory 10, on the other hand, can support the user while the user is attempting to stand, enhancing the safety of the learning process.

The inventor(s) also envisages that the accessory 10 can be used for amusement or entertainment by those not particularly interested in learning to ski. Also, the accessory 10 can be used by children who may not necessarily be old enough to learn to ski, but can still benefit from the enjoyable aspects and excitement of the skiing experience.

In FIGS. 2 to 5 there is shown some detail of the swivel connector 14.

The connector 14 includes a pair of clamp members 32, 33; each profiled to accommodate the ski boom 16. The clamp member 32 is connected to the arm 20 and the clamp member 33 is pivotally connected to the clamp member 32. To that end, the clamp member 32 includes a sleeve or bush 34 interposed between a pair of spaced bushes or sleeves 36 of the clamp member 33. A pivot pin 38 is received through the sleeves 34, 36. Thus, the clamp member 33 is capable of pivoting towards and away from the clamp member 32 as indicated in the drawings to release or engage the ski boom 16.

The clamp members 32, 33 are configured so that they can swivel or rotate about the boom 16 when fastened together. The swivel connector 14 is coated with the same material as the arm 20 and lift member 26. That material is sacrificial, thus protecting the boom 16 from wear.

The clamp members 32, 33 define connecting lugs 42, 44, respectively. The lug 44 defines a recess 46. A threaded rod 48 extends through the recess 46 and is pivotally connected to the lug 42. The rod 48 can thus be pivoted out of the recess 46 when the clamp members 32 are released.

The lug 44 includes a wall 52 that defines a recess 54 that is positioned so that an end of the rod 48 is received in the recess 54 when the rod 48 is pivoted out of the recess 54. A nut and washer arrangement 56 is threaded onto the rod 48 so that the clamp members 32, 34 can be driven towards each other to secure the swivel connector 14 to the ski boom 16.

The inventor(s) envisages that a variety of different configurations can be used to achieve the functionality of the accessory 10. For example, FIGS. 6 to 9 show exemplary accessories that can achieve a similar functionality.

Figure 6:
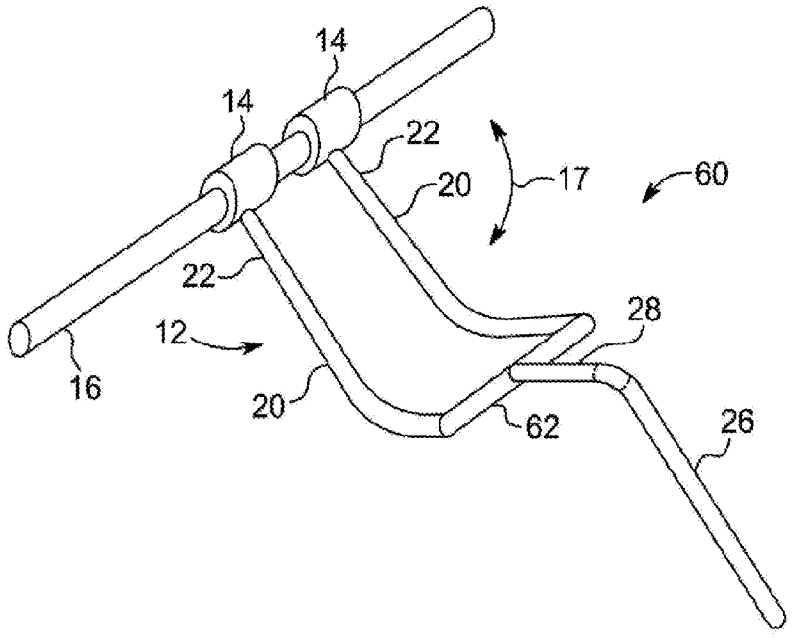
FIG. 6 shows a three-dimensional view of an exemplary embodiment of a water ski accessory.

In FIG. 6, reference numeral 60 generally indicates an exemplary water ski accessory. With reference to the preceding drawings, like reference numerals refer to like parts, unless otherwise specified.

The accessory 60 includes two arms 20, each of which are connected, at one end, to the ski boom 16 with a swivel connector 14, as described above. A crossbar 62 is connected between corresponding opposite ends of the arms 20. The lift member 26 extends from the cross bar 62, intermediate ends of the crossbar 62.

In this example, the user can be seated on the crossbar 62 while holding the ski boom 16. As with the accessory 10, a suitable cushioned seating arrangement can be positioned on the arms 20 and the crossbar 62.

Figure 7:
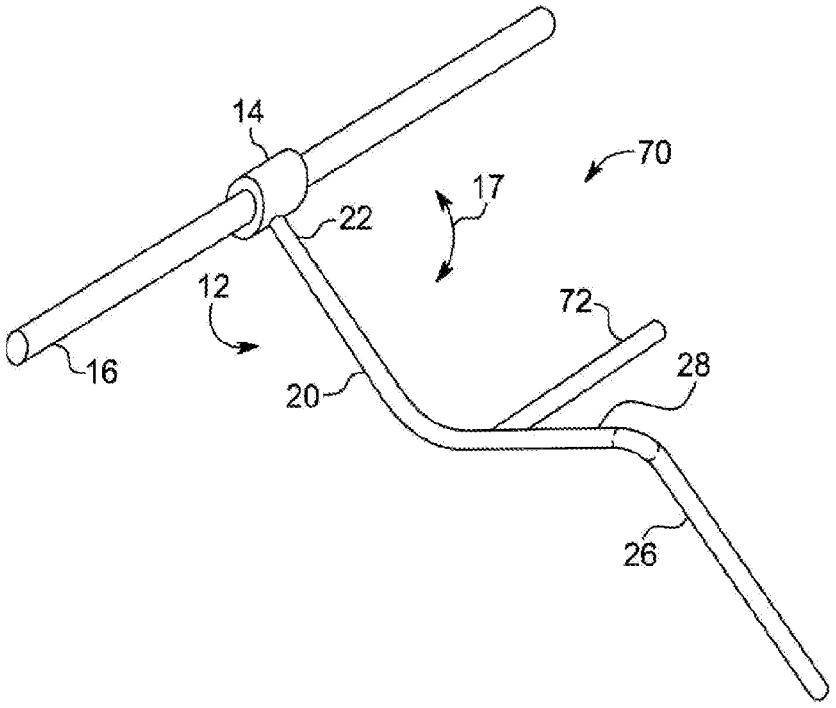
FIG. 7 shows a three-dimensional view of an exemplary embodiment of a water ski accessory.

In FIG. 7, reference numeral 70 generally indicates an exemplary water ski accessory. With reference to the preceding drawings, like reference numerals refer to like parts, unless otherwise specified.

In this example, a seat post 72 extends from the arm 20, to be generally parallel to the ski boom 16. A user can be seated on the post 72 while holding the ski boom 16. As above, a suitable cushioned seating arrangement can be positioned on the post 72.

Figure 8:
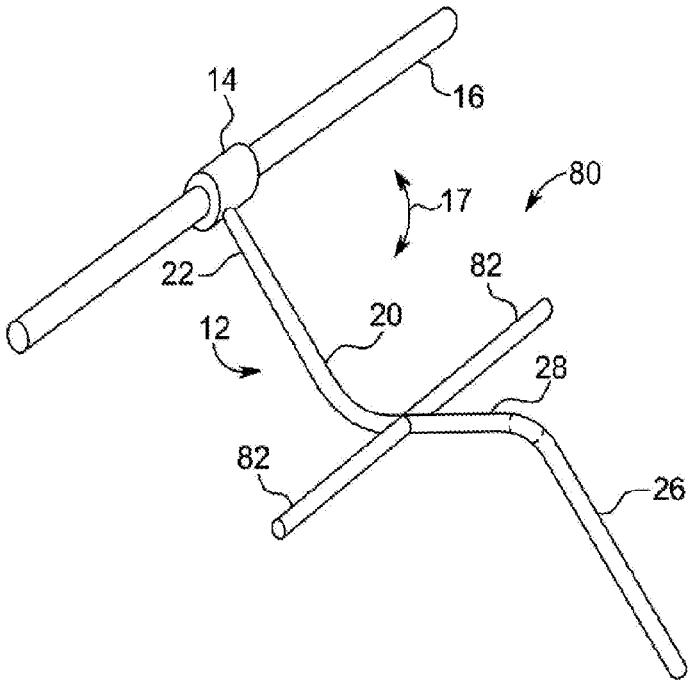
FIG. 8 shows a three-dimensional view of an exemplary embodiment of a water ski accessory.

In FIG. 8, reference numeral 80 generally indicates an exemplary water ski accessory. With reference to the preceding drawings, like reference numerals refer to like parts, unless otherwise specified.

In this example, a pair of opposed seat posts 82 extend from the arm 20 along a line generally parallel to the ski boom 16. A user can be seated on the seat posts 82 with the arm 20 extending between his or her legs. As above, a suitable cushioned seating arrangement (not shown) can be positioned on the posts 82 and the arm 20.

Figure 9:
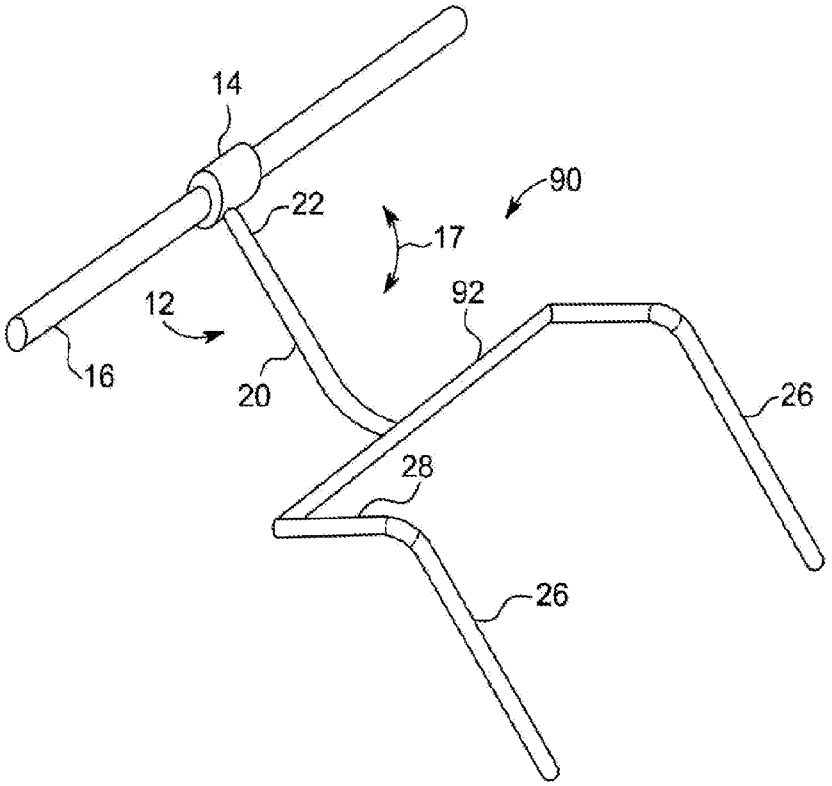
FIG. 9 shows a three-dimensional view of an exemplary embodiment of a water ski accessory.

In FIG. 9, reference numeral 90 generally indicates an exemplary water ski accessory. With reference to the preceding drawings, like reference numerals refer to like parts, unless otherwise specified.

In this example, there is provided a pair of the lift members 26. The lift members 26 extend from respective ends of a crossbar 92. The arm 20 is mounted to the crossbar 92. A user can be seated on the crossbar 92 with the arm 20 extending between his or her legs. As above, a suitable cushioned seating arrangement can be positioned on the crossbar 92 and the arm 20.

Figure 10:
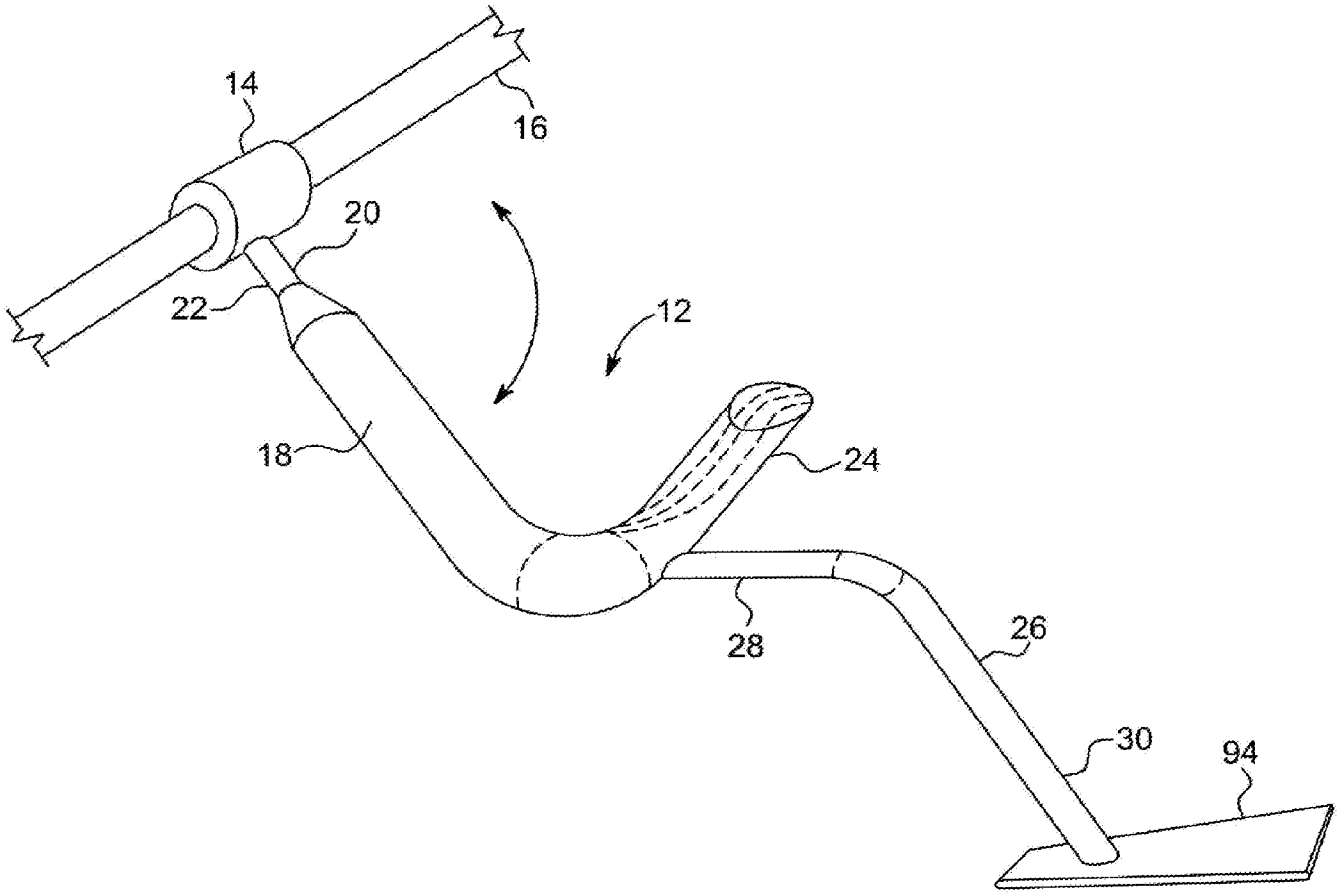
FIG. 10 shows a three-dimensional view of an exemplary embodiment of a water ski accessory with an example of a suitable lift member.
Figure 11:
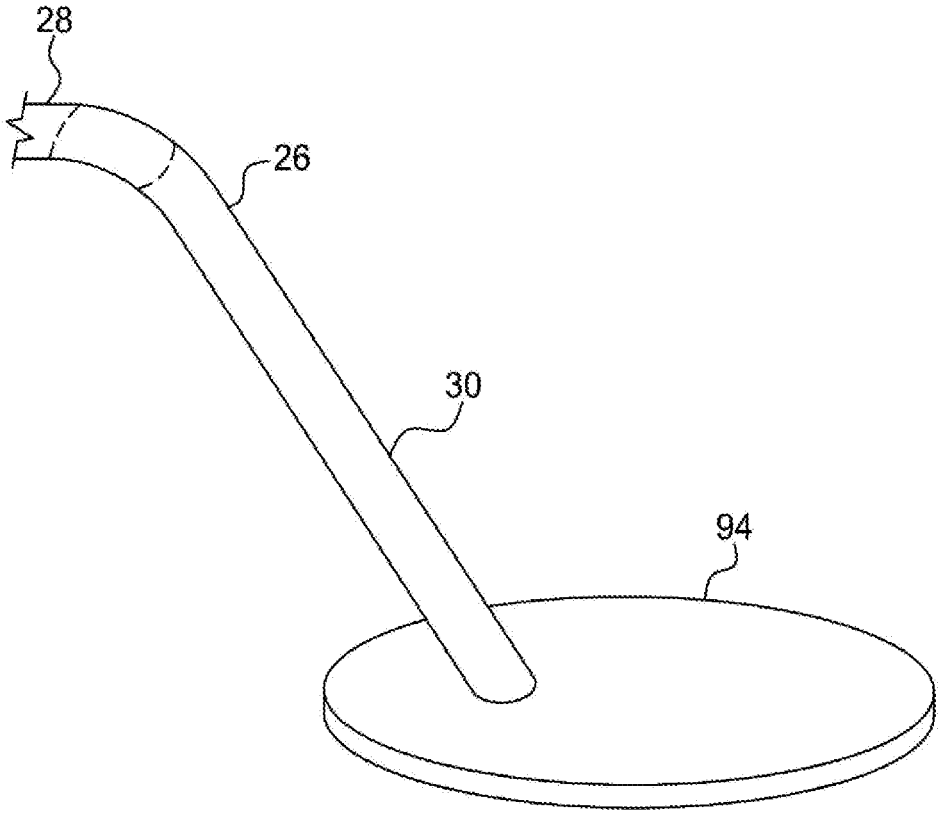
FIG. 11 shows a three-dimensional view of an exemplary embodiment of a water ski accessory with another example of a suitable lift member.

In some cases, it may be desirable for added lift to be generated as the lift member 26 is dragged through the water. Thus, a blade 94 is mounted on an end of the lift member 26. The blade 94 can have straight edges, for example, it can be triangular, or rectangular, as shown in FIG. 10. Alternatively, the blade 94 can have an elliptical profile, as shown in FIG. 11. The blade 94 may be releasably fixed to the lift member 26.

The blade 94 is oriented with respect to the lift member 26 to assist in driving the accessory upwardly, as would a blade on a hydrofoil.

The inventor(s) envisages that it may be necessary for a user to have some form of arrangement or formation that can be grasped to provide the user with stability and confidence.

Figure 12:
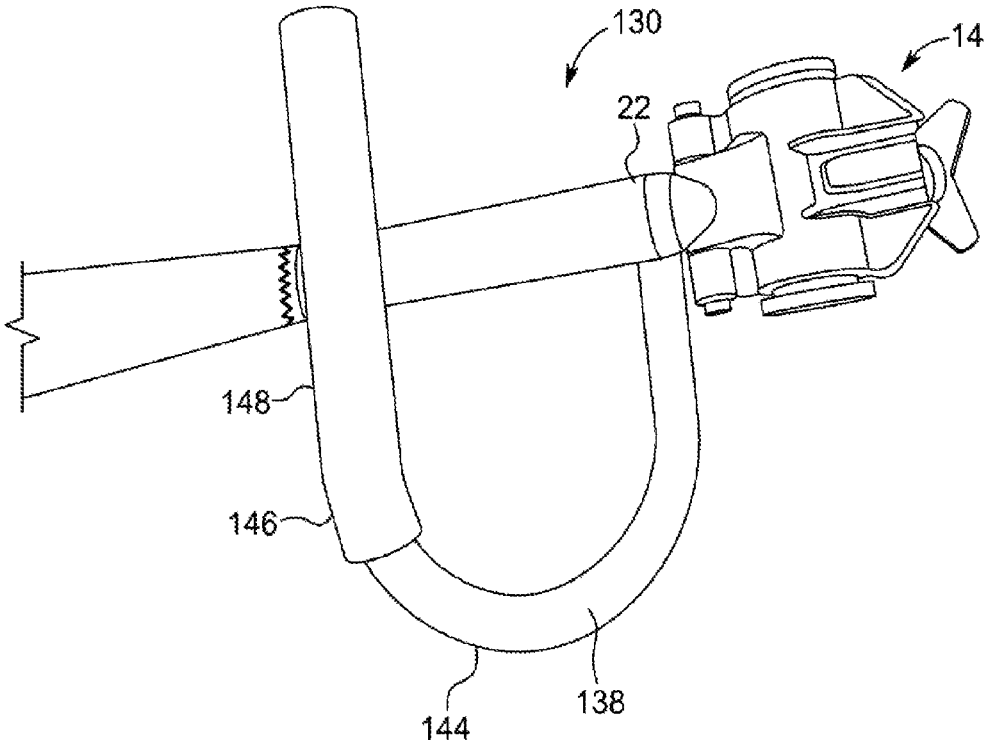
FIG. 12 shows a three-dimensional view of an exemplary embodiment of a handle assembly of the water ski accessory.
Figure 13:
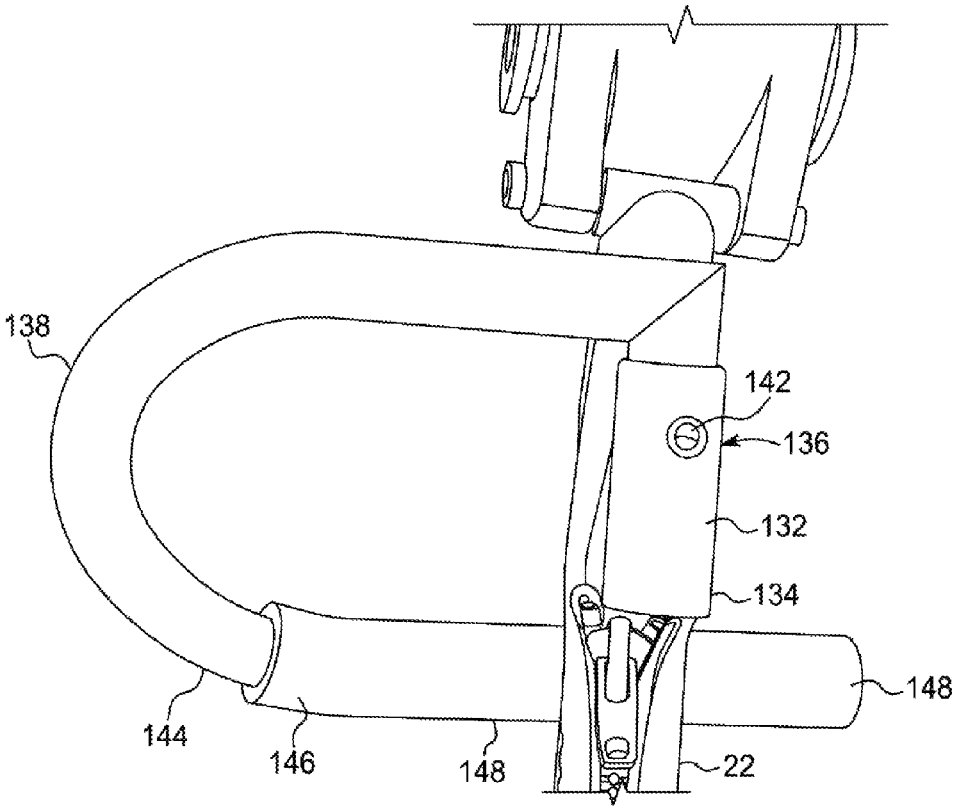
FIG. 13 shows another three-dimensional view of the handle assembly of FIG. 12.

Thus, the accessory 10 can include a handle assembly 130, as shown in FIGS. 12 and 13. In those drawings, like reference numerals refer to like parts, unless otherwise specified.

The handle assembly 130 includes a socket member 132 that is mounted on the front portion 22 of the support bar 20 in an orientation in which the front portion 22 is interposed between a user and the socket member 132. A wall 134 of the socket member 132 defines an opening 136.

A handlebar 138 is mounted in the socket member 132 and extends about the front portion 22 so that a user can grasp the handlebar 138, with both hands, for example. In particular, the handlebar 138 includes a leg 140 that is received in the socket member 132. The leg 140 has a spring mounted locking pin 142 that can be pushed into the leg 140 and can snap or click into the opening 136 to secure the leg 140 in the socket member 132. The opening 136 and leg 140 may be square or round or any other suitable shape so that the leg 140 can nest in the opening 136 of the socket member 132.

An arm 144 extends from the leg 140 about the front portion 22 to define a handle 146 that can be grasped by the user. A padded sleeve 148 can be arranged on the handle 146 for comfort and to facilitate grip.

Figure 14:
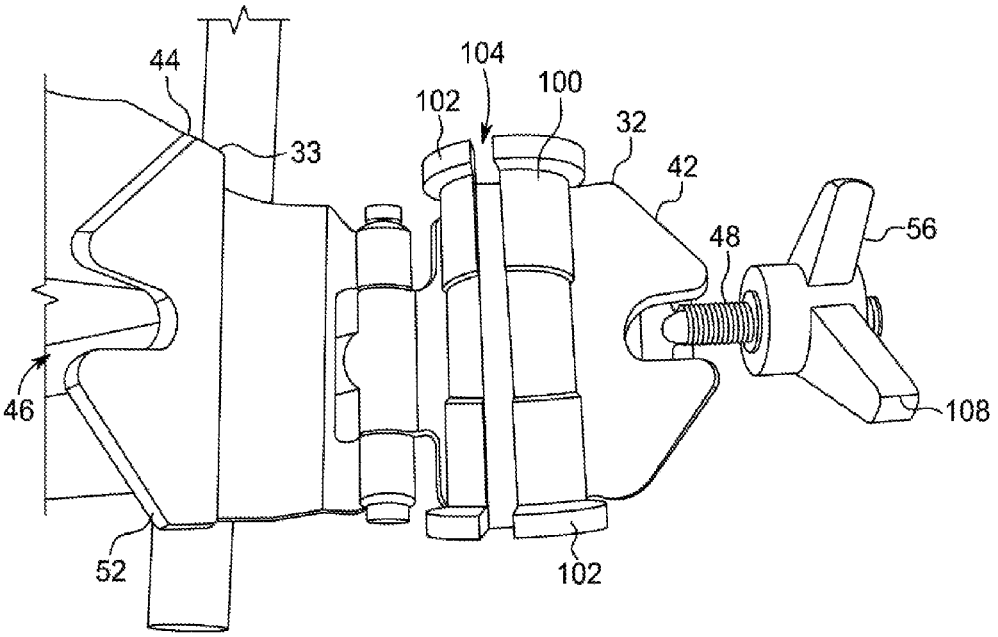
FIG. 14 shows a three-dimensional view of another exemplary embodiment of a swivel connector of the accessory.
Figure 15:
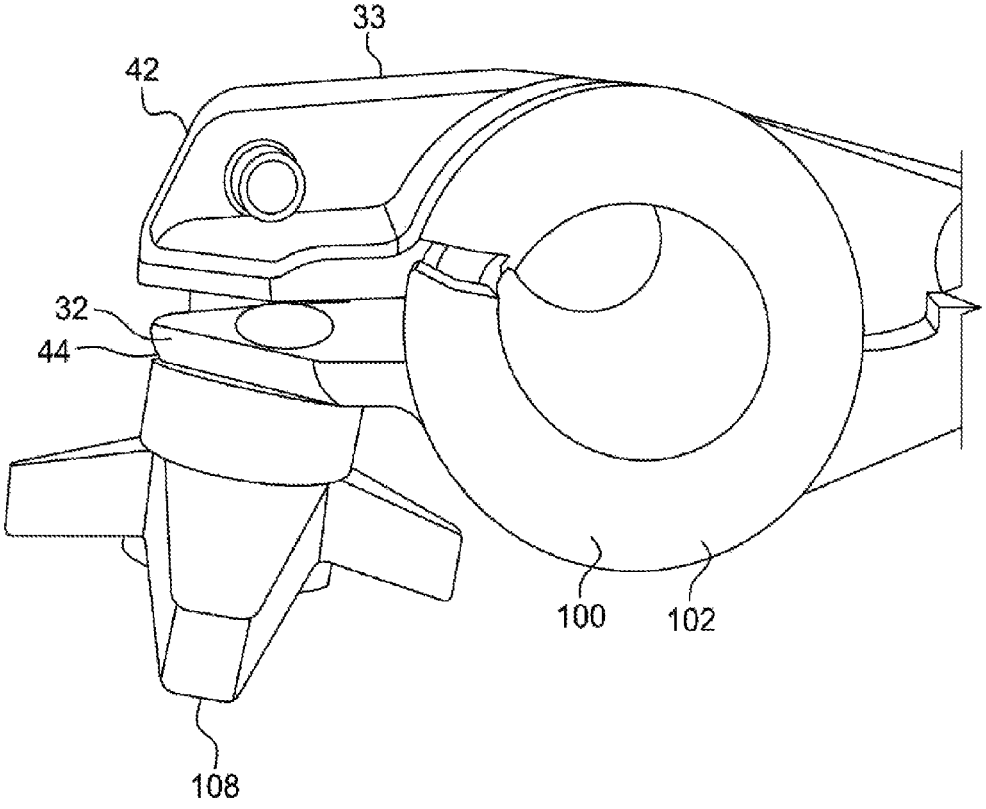
FIG. 15 shows a three-dimensional side view of the swivel connector of FIG. 14.

FIGS. 14 and 15 show an exemplary embodiment of the swivel connector 14. With reference to the preceding drawings, like reference numerals refer to like parts, unless otherwise specified.

Figure 16:
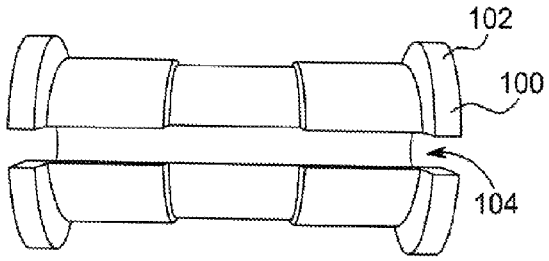
FIG. 16 shows a three-dimensional top view of a sleeve of the swivel connector of FIG. 14.

A sleeve 100 is received between the clamp members 32, 33 and about the ski boom 16, in use. A locating collar 102 is arranged on each end of the sleeve 100 to locate the sleeve 100 with respect to the clamp members 32, 33. Detail of the sleeve 100 is shown in FIG. 16.

The sleeve 100 is split at 104 and is of a flexible material so that it can be opened up and placed about the ski boom 16, in the appropriate position.

The sleeve 100 is of a material with a frictional coefficient that facilitates pivotal movement of the accessory 10, relative to the ski boom 16. The sleeve 100 can also be of a material suitable for protecting the ski boom from abrasive damage.

The sleeve 100 can thus be of any number of suitable materials. These would include a plastics material such as a polyethylene, a polypropylene or polytetrafluoroethylene (PTFE).

Thus, the sleeve 100 and the collars 102 can be of a one-piece, moulded material.

FIGS. 14 and 15 also show that the nut and washer arrangement 56 can include a nut with suitable finger grip formations 108 so that a user can manipulate the arrangement 56 to fasten the swivel connector 14 to the ski boom 16.

Figure 17:
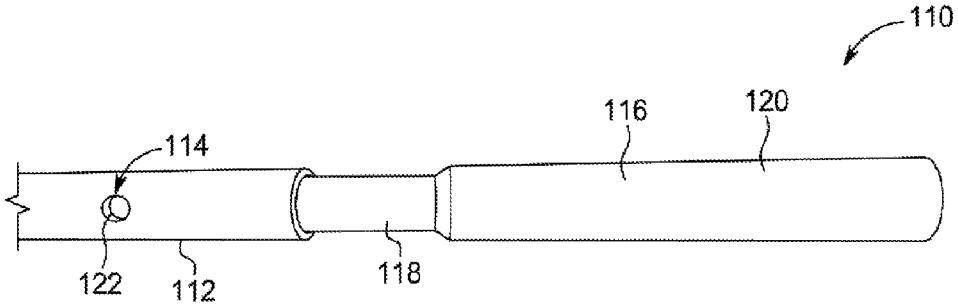
FIG. 17 shows a three-dimensional top view of an exemplary embodiment of lift member assembly of the accessory.
Figure 18:
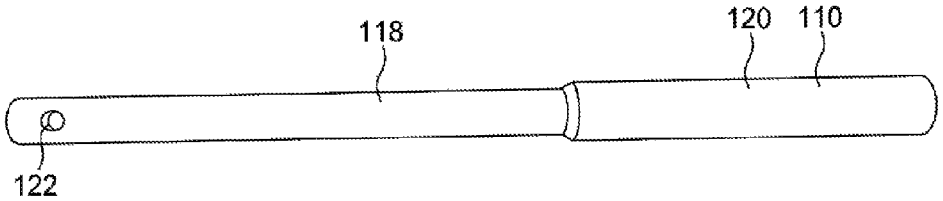
FIG. 18 shows a three-dimensional top view of a post of the lift member assembly of FIG. 17.
Figure 19:
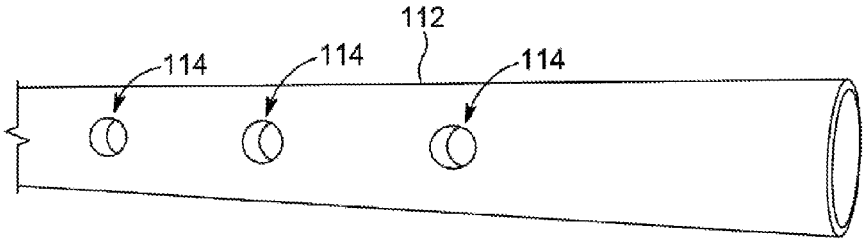
FIG. 19 shows a three-dimensional top view of a stem of the lift member assembly of FIG. 17.
Figure 20:
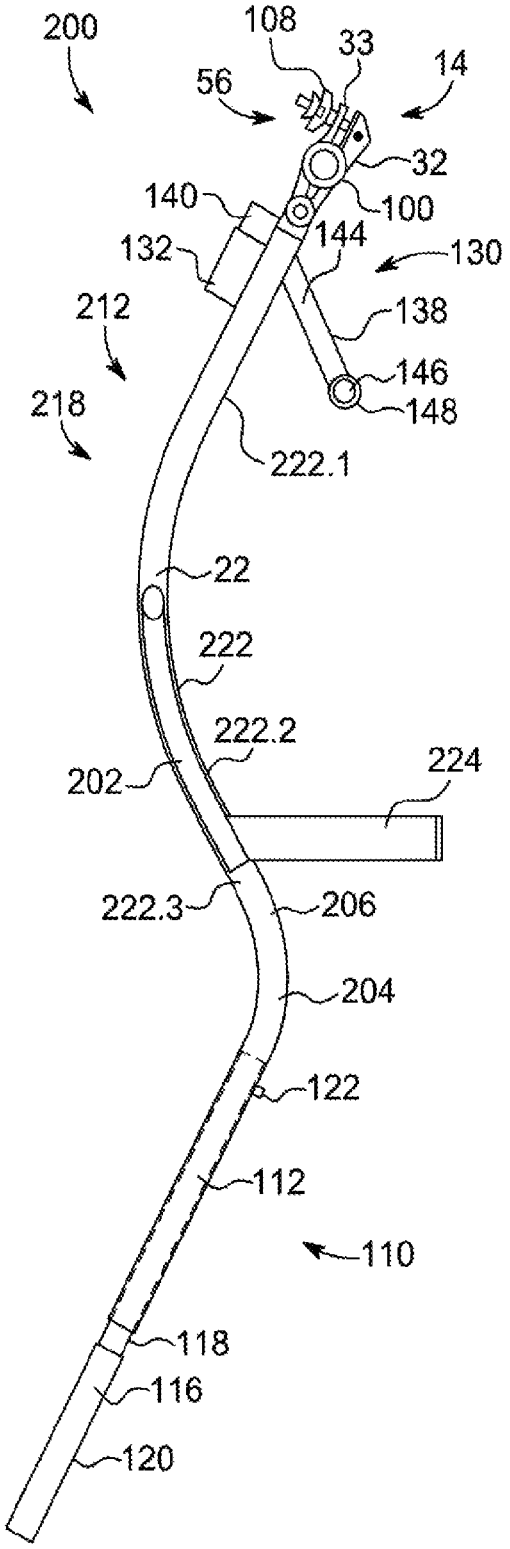
FIG. 20 shows a three-dimensional side view of another exemplary embodiment of a water ski accessory.

It will be appreciated that a length of the lift member 26 can affect the extent of lift that is generated. Thus, there is provided a lift member assembly 110, as shown in FIG. 17.

The lift member assembly 110 includes a stem 112 that is connected to the seat arrangement 18 in the same manner as the lift member 26. The stem 112 is tubular and defines a series of four openings 114.

The lift member assembly 110 includes a post 116 that is capable of being received at least partially within the stem 112. The post 116 includes an insert portion 118 and a tail portion 120. The insert portion 118 is dimensioned so that it can slide into the stem 112 in a telescopic arrangement. The tail portion 120 has a diameter that is generally the same as that of the stem 112.

A locking pin 122 is mounted on the insert portion 118. The locking pin 122 is spring mounted and is capable of being pushed into the insert portion 118 against a bias to allow the insert portion 118 to be inserted into the stem 112. The openings 114 are dimensioned so that the locking pin 122 can snap or click into any of the openings 114 when the locking pin 122 is aligned with that opening 114. Thus, an overall effective length of the post 116 and thus the lift member assembly 110 can be adjusted, as required, to provide different amounts of lifting force and lifting heights FIGS. 20 to 26 show another exemplary embodiment of a skiing accessory 200. With reference to the preceding drawings, like reference numerals refer to like parts, unless otherwise specified.

The skiing accessory 200 comprises the swivel connector 14, a support structure 212, the handle assembly 130, and the lift member assembly 110.

Figure 26:
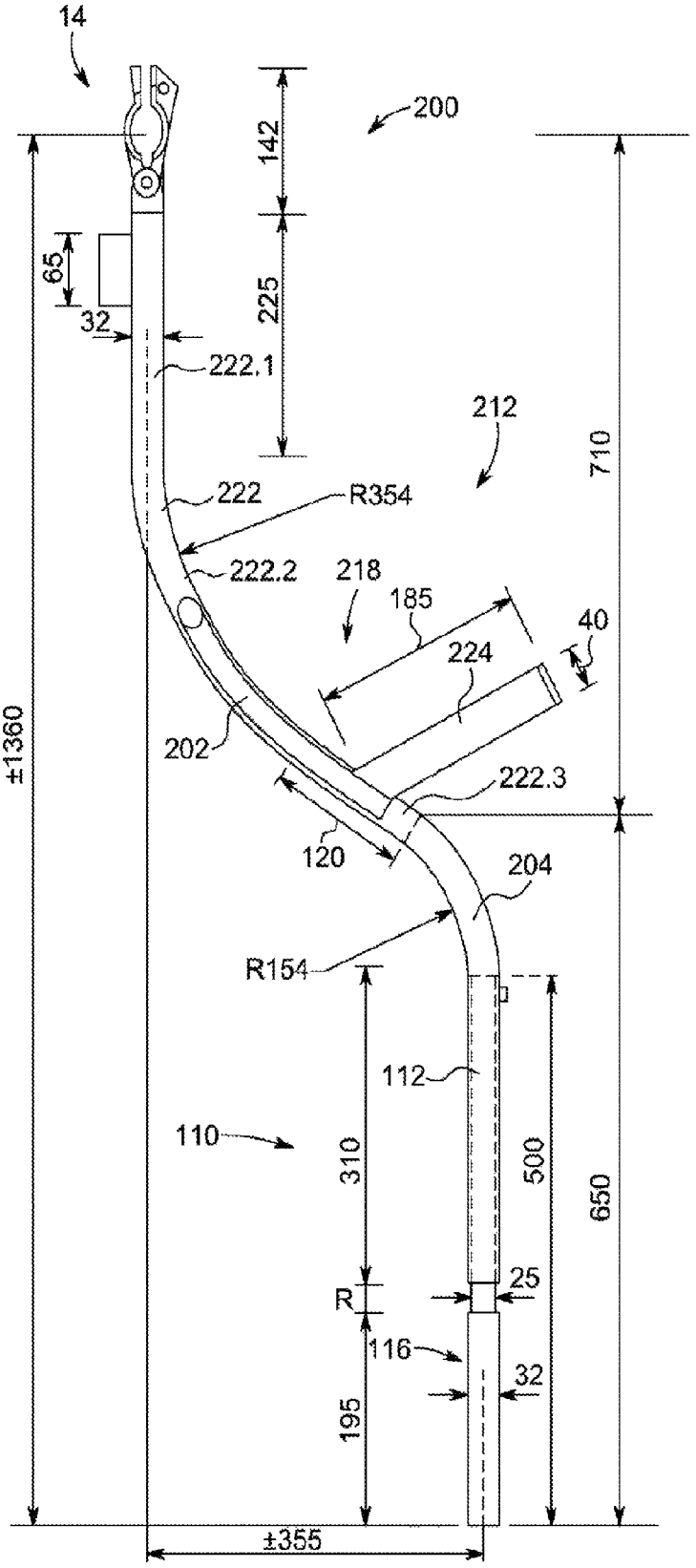
FIG. 26 shows a side view of the accessory of FIG. 20 with dimensions.

The support structure 212 is similar to the support structure 12. The support structure 212 includes a seat arrangement 218 including an arm 22. The arm 22 has a front portion 222 and a rear portion 224. The front portion 222 includes a straight section 222.1, a bent section 222.2 and further straight section 222.3. The front portion 222.1 can be between 175 mm and 275 mm long, for example 225 mm as shown in FIG. 26. The bent section 222.2 can have a radius of between 284 mm and 430 mm, for example 354 mm as shown in FIG. 26. The further straight section 222.3 can be between 95 mm and 145 mm long, for example 120 mm as shown in FIG. 26.

The support structure 212 includes platform members 202 as part of its seat arrangement 218. The platform members 202 are lengths of tube welded to opposite sides of the bent section 222.2 and further straight section 222.3 of the arm 22. The platform members 202 widen the portion of the seat arrangement 218 supporting the skier, in use.

The rear portion 224 is welded to an end region of the front portion 222, where the platform members 202 terminate proximate the lift member assembly 110. The rear portion 224 may stand between 150 mm and 210 mm tall, for example 185 mm as shown in FIG. 26. The rear portion 224 is angled with respect to the front portion 222.

The support structure 212 extends from the swivel connector 14 to the lift member assembly 110.

The lift member assembly 110 of the skiing accessory 200 includes a bend 204 which connects the stem 112 to the seat arrangement 218. The front portion 222 of the arm 22, the bend 204 and the stem 112 together comprise a single integrally formed tube 206 of the skiing accessory 200. The tube 206 is circular aluminium hollow section which is 32 mm in diameter with a 3 mm wall thickness and powder coated. The front portion 222 and the stem 112 extend generally parallel to each other.

The stem 112 can be between 250 mm and 370 mm long, for example 310 mm as shown in FIG. 26. The bend 204 can have a radius between 120 mm and 185 mm, for example 154 mm as shown in FIG. 26. The front portion 222 can be spaced parallel from the stem 120 mm by between 250 mm to 440 mm, for example 355 mm as shown in FIG. 26.

Figure 21:
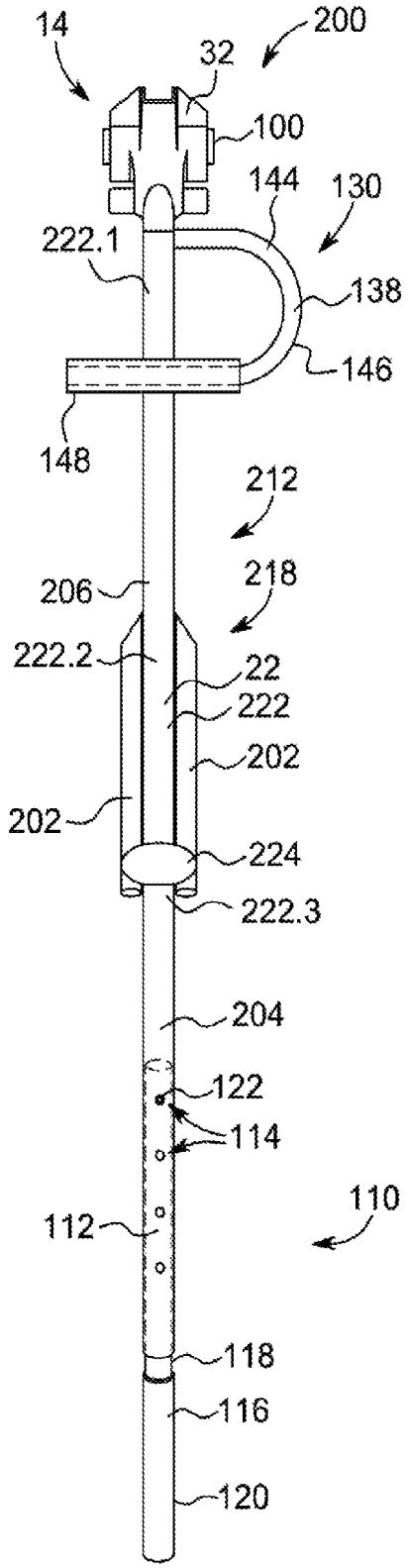
FIG. 21 shows a three-dimensional top view of the ski accessory of FIG. 20.
Figure 22:
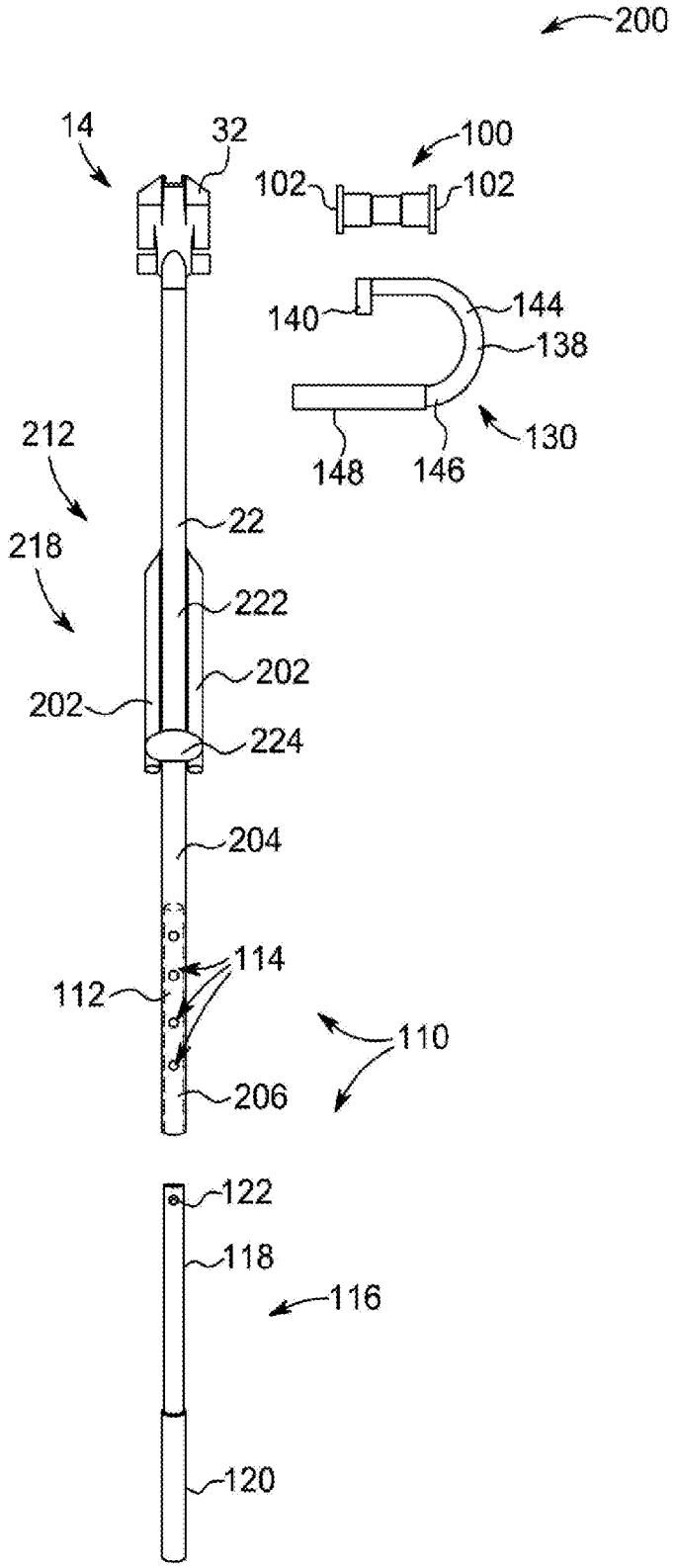
FIG. 22 shows a three-dimensional exploded top view of the ski accessory of FIG. 20.
Figure 23:
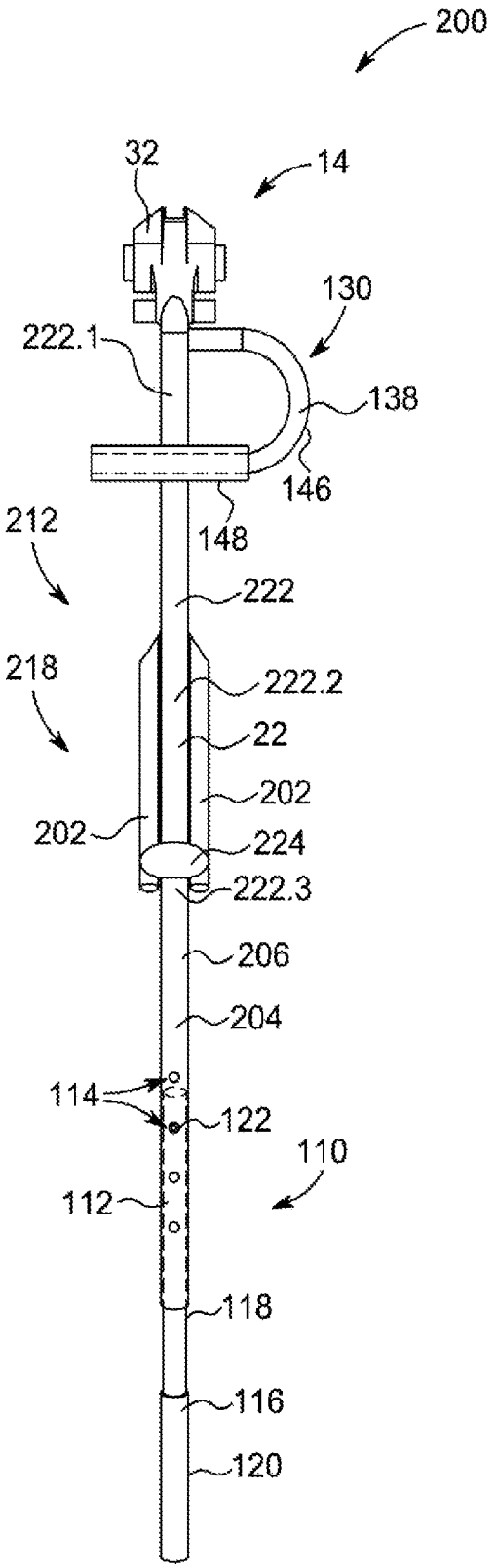
FIG. 23 shows a three dimensional top view of the ski accessory of FIG. 20 with a lift member assembly of the accessory in an extended condition.

FIG. 21 shows the post 116 inserted into the stem 112 to its deepest position where the locking pin 122 engages the deepest of the openings 114. FIG. 23 shows the post 116 slightly withdrawn relative to the position of the post 116 shown in FIG. 21, in an extended condition of the lift member assembly 110. The locking pin 122 engages the second deepest opening 114 in the stem 112 in the extended condition of the lift member assembly 110. The overall length of the of the lift member assembly 110 shown in FIG. 21 is thus less than the overall length of the lift member assembly 110 in the extended condition shown in FIG. 23. Each opening 114 is spaced approximately 58 mm from an adjacent opening 114 in the series of openings. The overall length of the lift member assembly 110 is thus adjustable in three 58 mm increments. The overall length of the of the lift member assembly 110 in the condition shown in FIGS. 21 and 26 can be between 515 mm to 785 mm, for example 650 mm as shown in FIG. 26.

The overall length of the skiing accessory 200, measured from the centre of the swivel connector 14 (at a point about which the skiing accessory 200 swivels) to the distal end of the post 116, when the post 116 is in its deepest position as shown in FIGS. 21 and 26, can be between 1050 mm and 1650 mm, for example 1360 mm as shown in FIG. 26. The rear portion 224 of the arm 22 is approximately halfway between the centre of the swivel connector 14 and the distal end of the post 116. The overall length of the skiing accessory 200 can be selectively extended from the deepest position of the post 116 by a maximum extension of between 100 mm to 250 mm, for example 174 mm as provided by the openings 114 in the stem 112.

The distance from the centre of the swivel connector 14 to the end of the support structure 212 can be between 540 mm and 840 mm, for example 710 mm as shown in FIG. 26.

FIG. 26 shows dimensions of the skiing accessory 200 as discussed, in millimetres.

Figure 24:
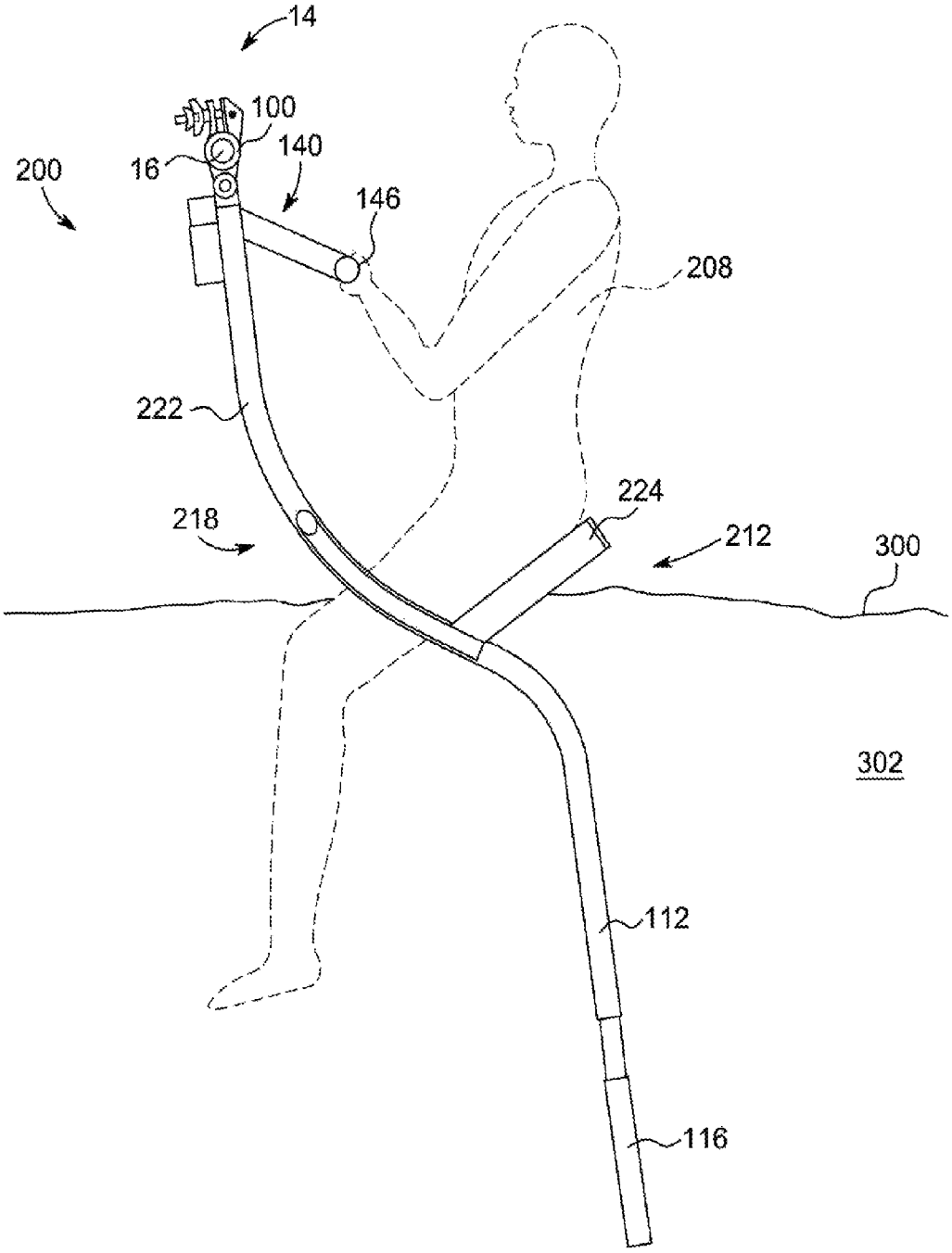
FIG. 24 shows a side view of the accessory of FIG. 20, in use, with a skier supported while the accessory is relatively stationary.
Figure 25:
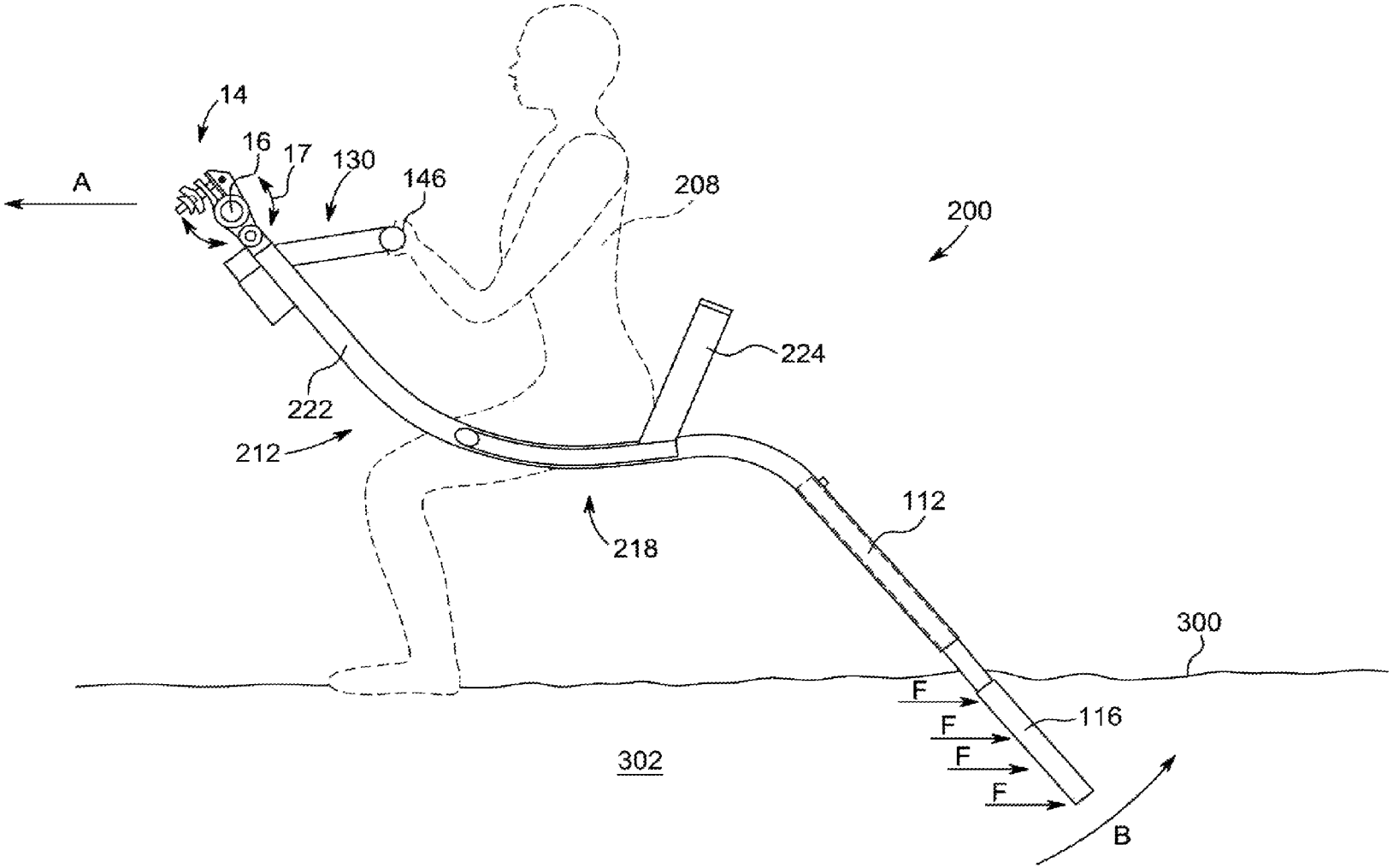
FIG. 25 shows a side view of the accessory of FIG. 20, in use, with a skier supported while the accessory is being towed.

FIGS. 24 and 25 show the skiing accessory 200, in use. The skiing, accessory 200 is pivotally connected to the ski boom 16. The swivel connector 14 connects the support structure 212 to the ski boom 16 in a configuration wherein the support structure 212 can pivot about an axis that is parallel to the ski boom 16 as indicated by arrow 17. A barefoot skier 208 is supported by the seat arrangement 218. The skier 208 grips the handle 146. A water surface line of a skiing substrate in the form of a body of water 302 is indicated by reference numeral 300.

FIG. 24 shows the skiing accessory 200 in a condition or orientation when the ski boom 16 is relatively stationary. The seat arrangement 218 is partially submerged in the water. The post 116 extends generally vertically downwardly into the water. The skier 208 is seated on the seat arrangement 218 with at least his/her legs submerged in the water.

FIG. 25 shows the skiing accessory 200 in a condition or orientation when the ski boom 16 is travelling forward as indicated by arrow "A". It will be appreciated that the ski boom 16 is travelling forward at speeds for barefoot water skiing as previously discussed for children and adults.

The post 116 of the lift member assembly 110 drags in the water as the skiing accessory 200 is pulled forward by the boom 16. The water pushes against the post 116 as indicated by arrows F, causing the support structure 212 to pivot upwardly by the upward force as indicated by arrow B. Upward pivoting of the support structure 212 raises the seat arrangement 218 relative to the water surface 300. The skier 208 is raised, lifted or supported by the seat arrangement 218 so that his/her feet can be placed on the water surface 300.

It will be appreciated that the upward force exerted on the lift member assembly 110 varies with the speed of forward movement. Similarly, by extending the post 116 the surface area of the lift member assembly 110 is increased so that a relatively greater upward force can be exerted for a given speed to raise the seat arrangement 218. Varying the length of the lift member assembly 110 also allows for variation of the height to which the seat arrangement 218 may be raised relative to the water surface 300.

Figure 27:
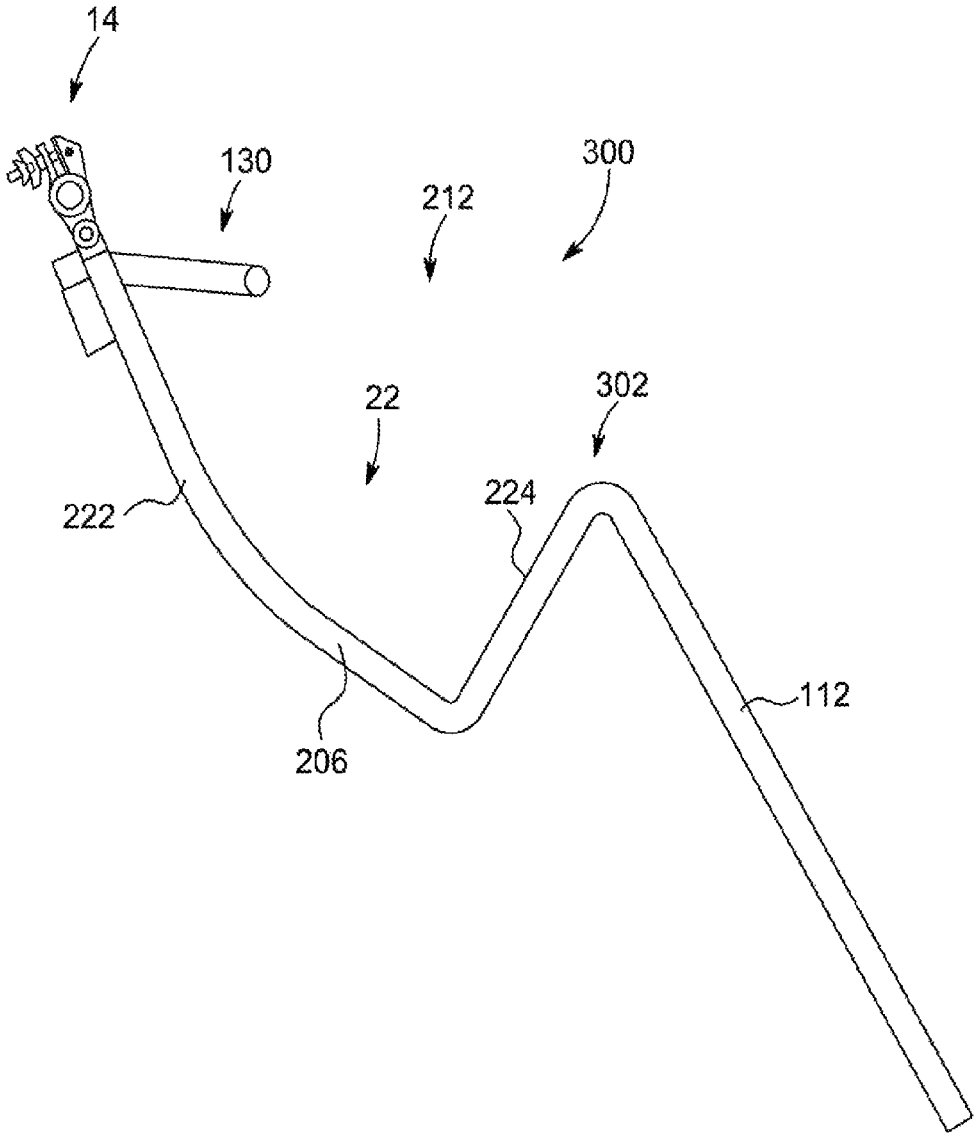
FIG. 27 shows a side view of yet another exemplary embodiment of a water ski accessory.

FIG. 27 shows yet another exemplary embodiment of a skiing accessory 300. The skiing accessory 300 is the same/similar to the skiing accessory 200, with the only difference being the tube 206 is configured to define the rear portion 224 of the arm 22. With reference to the preceding drawings, like reference numerals refer to like parts, unless otherwise specified. The stem 112 extends from an upper end 302 of the rear portion 224 of the arm 22. The support structure 212 and stem 112 of the skiing accessory 300 are integrally formed from the tube 206. The stem 112 may be similar to the lift member 26.

Figure 28:
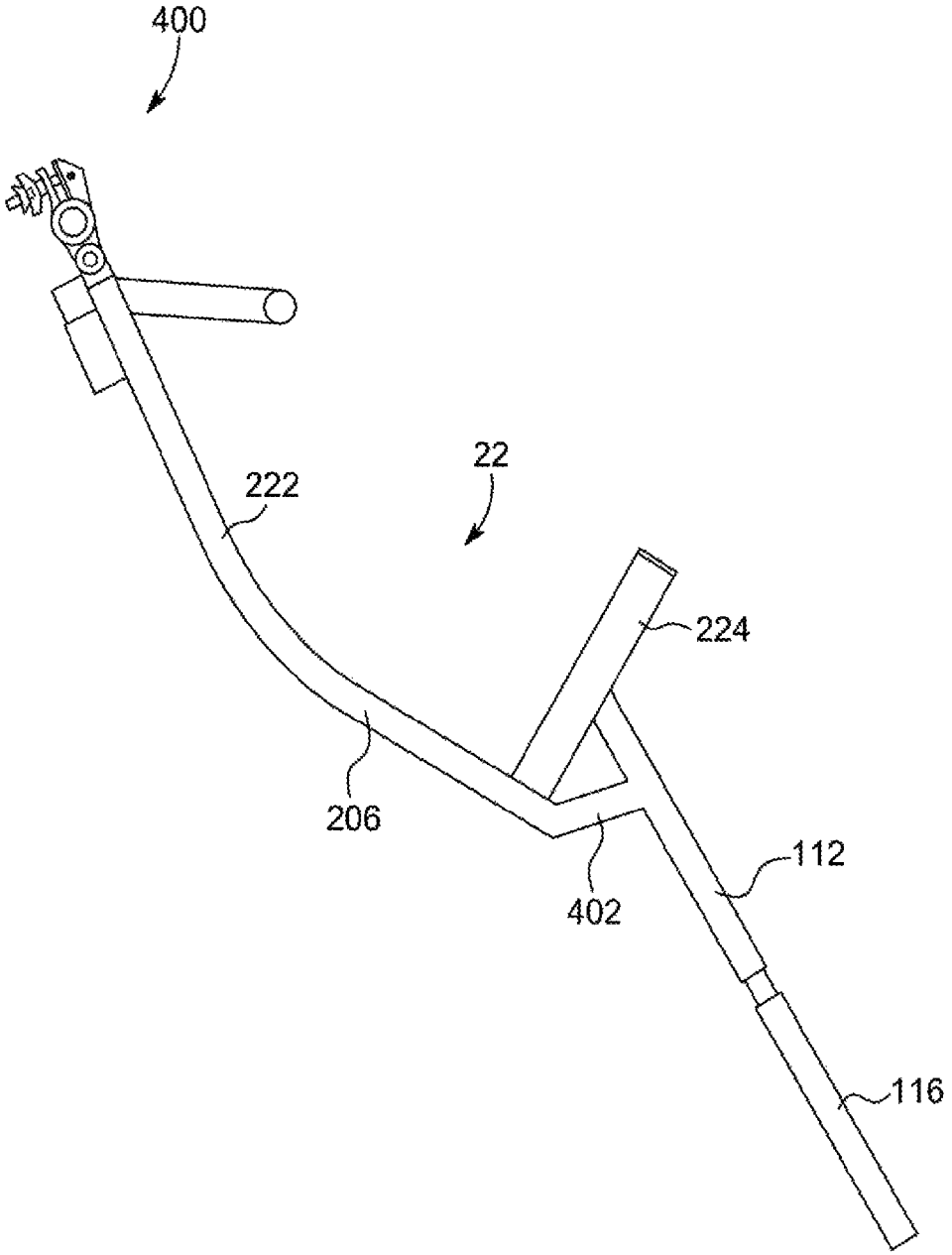
FIG. 28 shows a side view of still another exemplary embodiment of a water ski accessory.

FIG. 28 shows still another exemplary embodiment of a skiing accessory 400. The skiing accessory 400 is the same/similar to the skiing accessory 200, with the main difference being that-the stem 112 is fixed directly to the rear portion 224 of the arm 22. With reference to the preceding drawings, like reference numerals refer to like parts, unless otherwise specified. The stem 112 attaches to the rear portion 224 at a position approximately halfway up the rear portion 224. Attachment of the stem 112 to the rear portion 224 is reinforced by a brace 402. The brace 402 extends between the stem 112 and the bottom of the rear portion 224.

Figure 29:
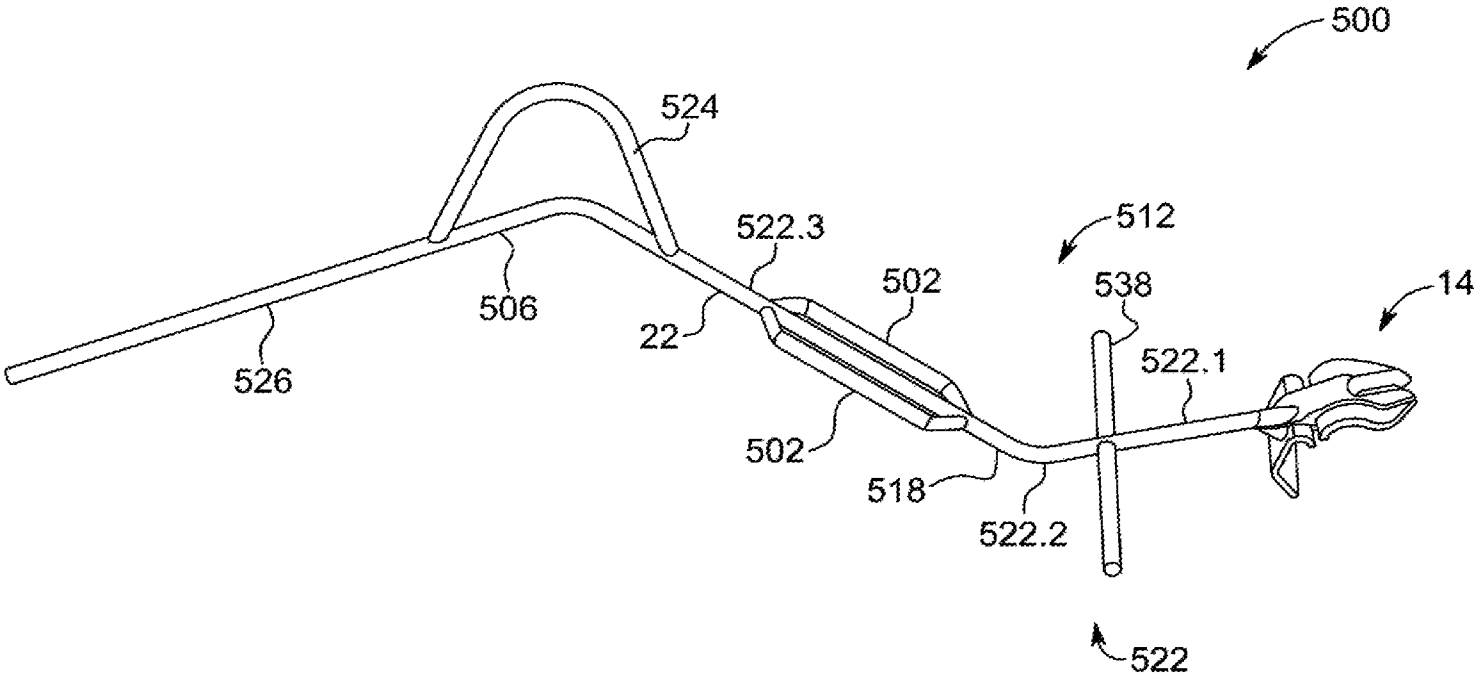
FIG. 29 shows a three-dimensional view of another exemplary embodiment of a water ski accessory.

FIG. 29 shows another exemplary embodiment of a skiing accessory 500. With reference to the preceding drawings, like reference numerals refer to like parts, unless otherwise specified.

The skiing accessory 500 comprises the swivel connector 14, a support structure 512, a handlebar 538, and a lift member 526.

The support structure 512 is similar to the support structure 12. The support structure 512 includes a seat arrangement 518 including an arm 22. The arm 22 has a front portion 522 and a rear portion 524. The front portion 522 includes a straight section 522.1, a bent section 522.2 and a further straight section 522.3.

The support structure 512 includes platform members 502 as part of its seat arrangement 518. The platform members 502 are lengths of tube welded to opposite sides of the further straight section 522.3.

The handlebar 538 is a length of tube extending through the straight section 522.1 of the arm 22. The handlebar 538 is orthogonal relative to the straight section 522.1.

The rear portion 524 is welded to an end region of the section 522.3 of the arm 22. The rear portion 524 is angled with respect to the section 522.3. The rear portion 524 bends backwards to connect to lift member 526.

The front portion 522 of the arm 22 and the lift member 526 together comprise a single integrally formed tube 506 of the skiing accessory 500.

The skiing accessory 500 is dimensioned and configured for two users to be supported by the support structure 512. One user may be supported by the platform members 502 and the other user by the rear portion 524.

Throughout the specification, including the claims, where the context permits, the term "comprising" and variants thereof such as "comprise" or "comprises" are to be interpreted as including the stated integer or integers without necessarily excluding any other integers.

It is to be understood that the terminology employed above is for the purpose of description and should not be regarded as limiting. The described embodiments are intended to be illustrative of the invention, without limiting the scope thereof. The invention is capable of being practised with various modifications and additions as will readily occur to those skilled in the art.

Various substantially and specifically practical and useful exemplary embodiments of the claimed subject matter, are described herein, textually and/or graphically, including the best mode, if any, known to the inventors for carrying out the claimed subject matter. Variations (e.g., modifications and/or enhancements) of one or more embodiments described herein might become apparent to those of ordinary skill in the art upon reading this application. The inventors expect skilled artisans to employ such variations as appropriate, and the inventors intend for the claimed subject matter to be practiced other than as specifically described herein. Accordingly, as permitted by law, the claimed subject matter includes and covers all equivalents of the claimed subject matter and all improvements to the claimed subject matter. Moreover, every combination of the above described elements, activities, and all possible variations thereof are encompassed by the claimed subject matter unless otherwise clearly indicated herein, clearly and specifically disclaimed, or otherwise clearly contradicted by context.

The use of any and all examples, or exemplary language (e.g., "such as") provided herein, is intended merely to better illuminate one or more embodiments and does not pose a limitation on the scope of any claimed subject matter unless otherwise stated. No language in the specification should be construed as indicating any non-claimed subject matter as essential to the practice of the claimed subject matter.

Thus, regardless of the content of any portion (e.g., title, field, background, summary, description, abstract, drawing figure, etc.) of this application, unless clearly specified to the contrary, such as via explicit definition, assertion, or argument, or clearly contradicted by context, with respect to any claim, whether of this application and/or any claim of any application claiming priority hereto, and whether originally presented or otherwise:

a. there is no requirement for the inclusion of any particular described or illustrated characteristic, function, activity, or element, any particular sequence of activities, or any particular interrelationship of elements;
b. no characteristic, function, activity, or element is "essential";
c. any elements can be integrated, segregated, and/or duplicated;
d. any activity can be repeated, any activity can be performed by multiple entities, and/or any activity can be performed in multiple jurisdictions; and
e. any activity or element can be specifically excluded, the sequence of activities can vary, and/or the interrelationship of elements can vary.

The use of the terms "a", "an", "said", "the", and/or similar referents in the context of describing various embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted.

Moreover, when any number or range is described herein, unless clearly stated otherwise, that number or range is approximate. Recitation of ranges of values herein are merely intended to serve as a shorthand method of referring individually to each separate value falling within the range, unless otherwise indicated herein, and each separate value and each separate subrange defined by such separate values is incorporated into the specification as if it were individually recited herein. For example, if a range of 1 to 10 is described, that range includes all values therebetween, such as for example, 1.1, 2.5, 3.335, 5, 6.179, 8.9999, etc., and includes all subranges therebetween, such as for example, 1 to 3.65, 2.8 to 8.14, 1.93 to 9, etc.

Accordingly, every portion (e.g., title, field, background, summary, description, abstract, drawing figure, etc.) of this application, other than the claims themselves, is to be regarded as illustrative in nature, and not as restrictive, and the scope of subject matter protected by any patent that issues based on this application is defined only by the claims of that patent.

The invention claimed is:

1. A skiing accessory comprising:

a support structure which is configured to support a skier relative to a skiing substrate;

a mounting arrangement arranged at an end of the support structure and configured to connect the support structure pivotally to a towing device; and at least one post that extends from support structure to engage the skiing substrate as the accessory is towed, the, or each, post being dimensioned so that the, or each, post pivotably rotates upwardly along with the support structure about the mounting arrangement as a result of drag on the, or each, post to a degree sufficient to lift the skier relative to the substrate.

2. The skiing accessory as claimed in claim 1, in which the mounting arrangement is configured to pivotally secure the skiing accessory to a ski boom about an axis that is generally parallel to the ski boom.

3. The skiing accessory as claimed in claim 2, in which the mounting arrangement includes at least one swivel connector fastenable to the ski boom.

4. The skiing accessory as claimed in claim 3, in which the support structure includes at least one arm that is attached to a respective swivel connector so that when the connector is fastened to the ski boom, the, or each, arm can pivot about the ski boom.

5. The skiing accessory as claimed in claim 1, in which the support structure includes a seat arrangement to permit a skier to sit on the support structure if required.

6. The skiing accessory as claimed in claim 1, in which the, or each, post is at least one elongate member that is of a selected length and profile to result in an upward force exerted on the support structure.

7. The skiing accessory as claimed in claim 6, in which the, or each, post includes a blade oriented relative to the, or each, post to assist in providing the upward force.

8. The skiing accessory as claimed in claim 1, in which the, or each, post, is a generally cylindrical post.

9. The skiing accessory as claimed in claim 1, in which the, or each, post is configured to be of variable length.

10. The skiing accessory as claimed in claim 9, in which the, or each, post is slidably receivable in a stem of the, or each, post such that an effective length of the, or each, post can be adjusted.

11. The skiing accessory as claimed in claim 10, in which the stem includes a series of longitudinally spaced openings and the, or each, post includes a pin receivable in one of the openings to set the effective length of the, or each, post.

12. The skiing accessory as claimed in claim 1, in which the support structure extends from the mounting arrangement to the, or each, post.

13. A method of assisting a skier comprising:

pivotally connecting a support structure of a skiing accessory to a towing device with at least a post extending from the support structure and into a skiing substrate, the, or each, post being dimensioned so that the, or each, post pivots upwardly as a result of drag on the, or each, post;

supporting the skier relative to the substrate on the support structure; and towing the skiing accessory at sufficient speed so that a force is exerted by the substrate on the, or each, post, thereby rotatably pivoting the, or each, post and support structure about the pivotal connection to the towing device to raise or lift the skier relative to the substrate.

14. The method as claimed in claim 13, in which the support structure is pivotally connected to a ski boom of a water craft.

15. A method, of assisting a skier, comprising:

pivotally connecting a support structure of a skiing accessory to a towing device with at least a post extending from the support structure and into a skiing substrate, the, or each, post being dimensioned so that the, or each, post pivots upwardly as a result of drag on the, or each, post, the skiing accessory including:

a support structure which is configured to support a skier relative to a skiing substrate; and a mounting arrangement arranged at an end of the support structure and configured to connect the support structure pivotally to a towing device;

supporting the skier relative to the substrate on the support structure; and towing the skiing accessory at sufficient speed so that a force is exerted by the substrate on the, or each, post, thereby pivotably rotating at the mounting arrangement raising the support structure upwardly to raise or lift the skier relative to the substrate.

16. The method of claim 15, in which the support structure is pivotally connected to a ski boom of a water craft.

* * * * *